US006805060B2

(12) United States Patent
Nicoletti

(10) Patent No.: US 6,805,060 B2
(45) Date of Patent: Oct. 19, 2004

(54) STRUCTURE FOR PIECES OF FURNITURE WITH VARIABLE CONFIGURATION

(75) Inventor: Bruno Nicoletti, Bologna (IT)

(73) Assignee: Work Corporation, Inc. S.r.l., Bologna (IT)

( * ) Notice: Subject to any disclaimer, the term of this patent is extended or adjusted under 35 U.S.C. 154(b) by 8 days.

(21) Appl. No.: 10/150,352

(22) Filed: May 16, 2002

(65) Prior Publication Data

US 2002/0171016 A1 Nov. 21, 2002

(30) Foreign Application Priority Data

May 17, 2001 (IT) ..... BO2001A0307

(51) Int. Cl.[7] ..... A47B 37/00
(52) U.S. Cl. ..... 108/50.01
(58) Field of Search ..... 108/50.01, 50.02, 108/153.1, 180, 182, 186; 312/194, 195, 223.1, 223.3

(56) References Cited

U.S. PATENT DOCUMENTS

| | | | | |
|---|---|---|---|---|
| 4,224,769 A | | 9/1980 | Ball et al. | |
| 4,630,550 A | * | 12/1986 | Weitzman | 108/180 |
| 5,345,881 A | | 9/1994 | Loescher | |
| 5,544,593 A | * | 8/1996 | Canfield et al. | 108/182 |
| 5,711,230 A | * | 1/1998 | Parsons | 108/186 |
| 6,024,024 A | | 2/2000 | Favaretto | |
| 6,062,149 A | * | 5/2000 | Duvivier et al. | 108/153.1 |
| 6,170,410 B1 | * | 1/2001 | Gioacchini et al. | 108/153.1 |
| 6,182,579 B1 | * | 2/2001 | Chang | 108/50.01 |
| 6,196,648 B1 | * | 3/2001 | Henriott | 108/50.01 |
| 6,220,180 B1 | * | 4/2001 | Janowitz | 108/50.01 |
| 6,220,186 B1 | * | 4/2001 | Scharer et al. | 108/153.1 |
| 6,516,732 B1 | * | 2/2003 | LaCombe et al. | 108/180 |

FOREIGN PATENT DOCUMENTS

| | | | |
|---|---|---|---|
| DE | 100 19 292 A | | 10/2001 |
| EP | 0 761 129 A | | 3/1997 |
| FR | 1 482 232 A | | 5/1967 |
| JP | 6-105718 | * | 4/1994 |

* cited by examiner

*Primary Examiner*—Jose V. Chen
(74) *Attorney, Agent, or Firm*—William J. Sapone; Coleman Sudol Sapone, P.C.

(57) ABSTRACT

A structure for pieces of furniture of variable configuration includes a plurality of different types of assembling elements, which are coupled with one another, in a stable and removable way, to support a desktop at a predetermined distance from the ground. The types of assembling elements include a sleeve, hollow inside and equipped, in its lateral wall, with male quick connection joint means, formed by a pair of pins. Another element is a bar for coupling with a pair of the sleeves, and being equipped, at both extremities, with female quick connectors, which include a pair of blocks featuring a longitudinal hole, which receives the pins, and a through hole containing a dowel for locking the pins. The desktop is supported by desktop bearing brackets. Moreover, legs are fastened to the sleeves to support the bar and the sleeves at a predetermined distance from the ground. Other elements of the structure include extension uprights, fixing into the sleeves, in a position orthogonal with respect to the desktop, to support other shelves, which form a bookcase over the desk.

17 Claims, 5 Drawing Sheets

FIG. 7
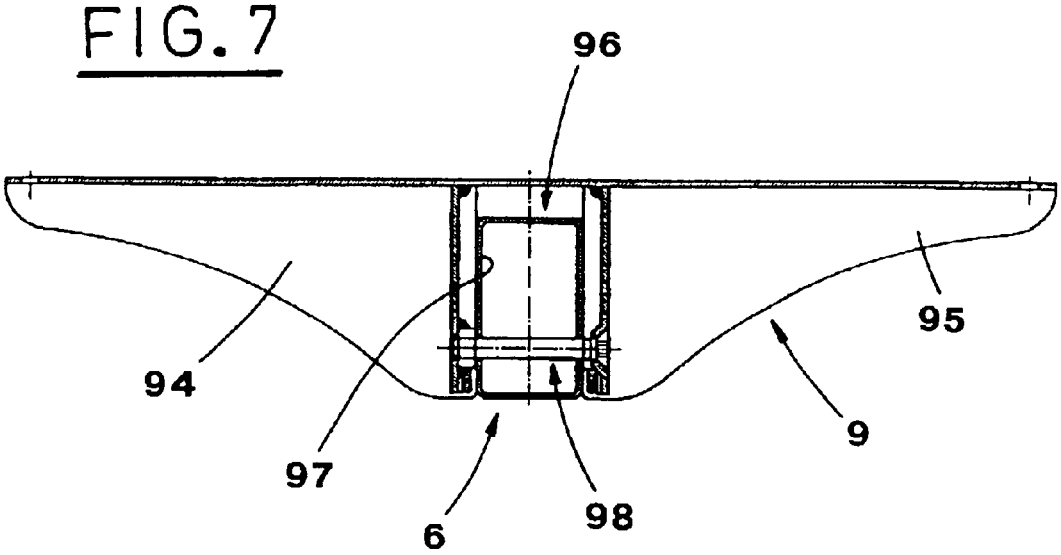
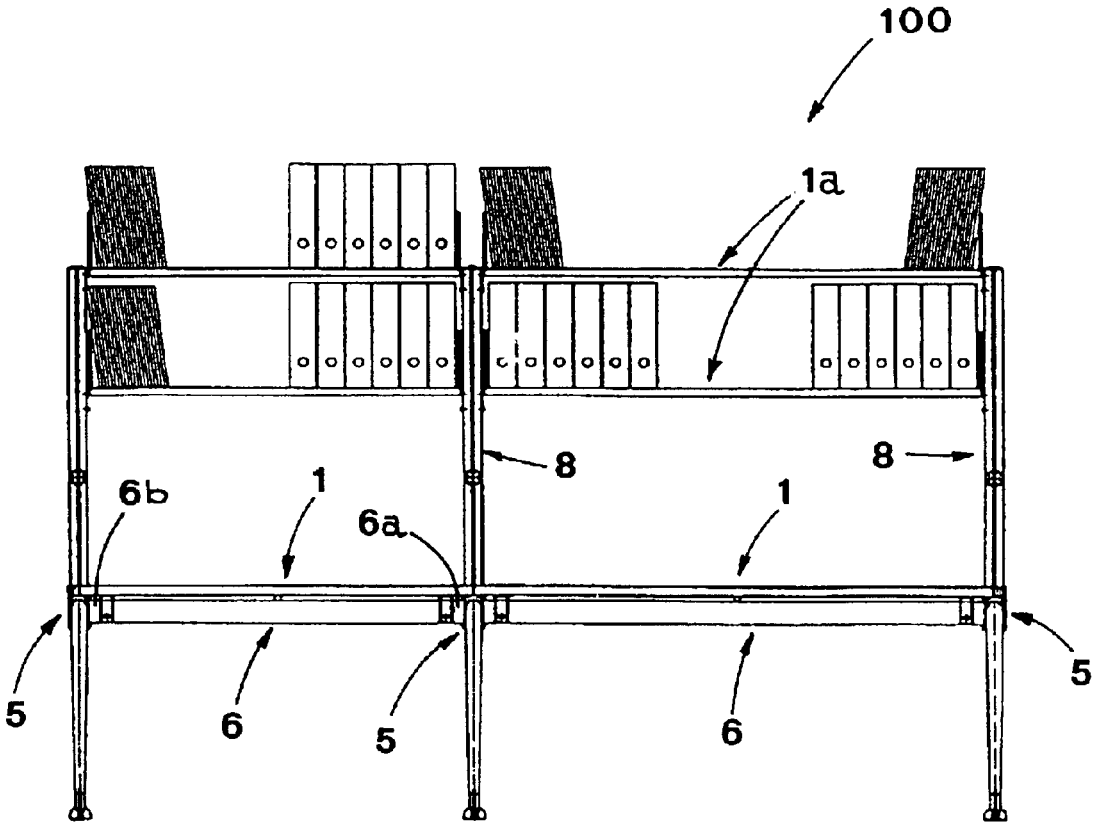
FIG. 2

FIG. 5
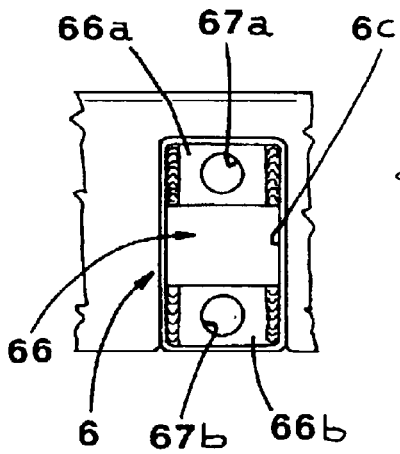
FIG. 4
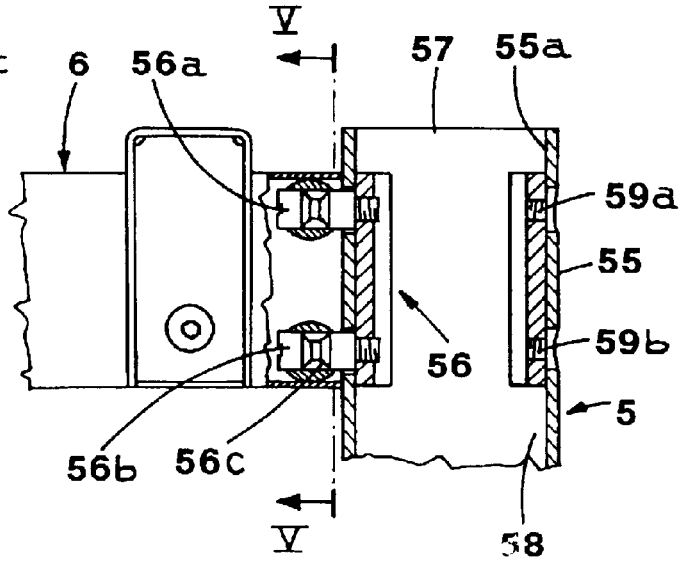
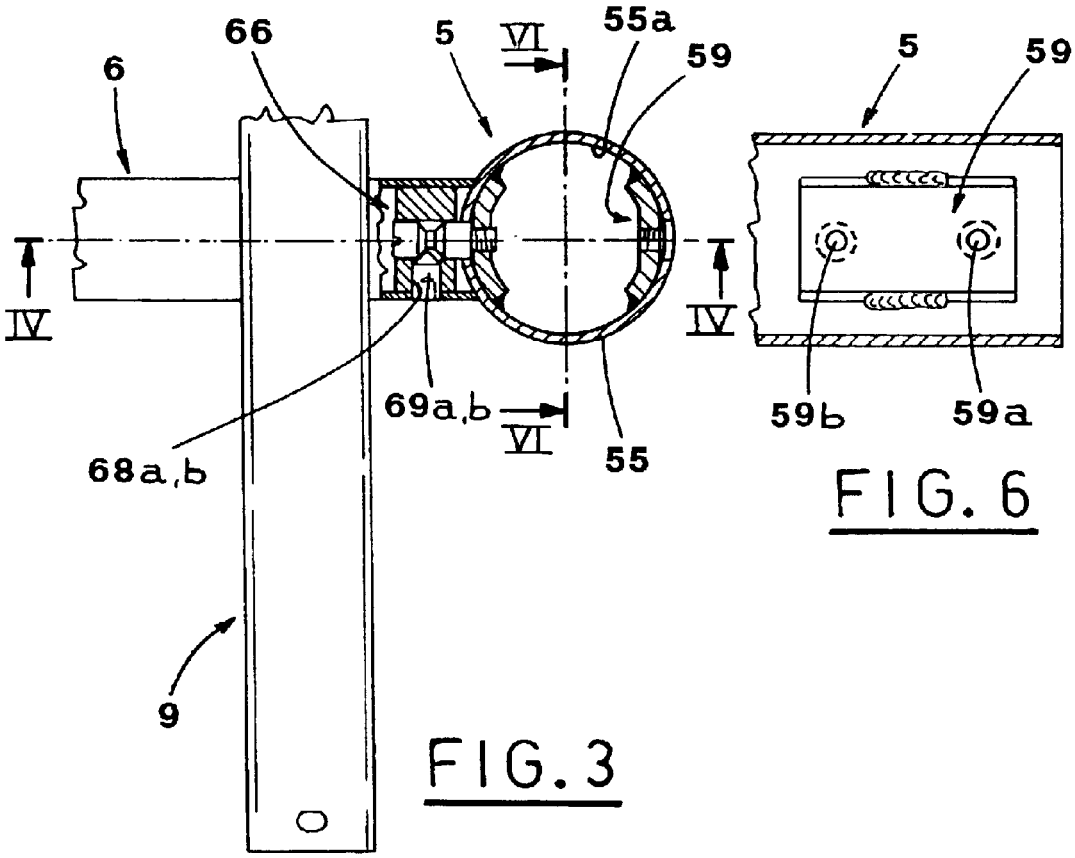
FIG. 6
FIG. 3

STRUCTURE FOR PIECES OF FURNITURE WITH VARIABLE CONFIGURATION

FIELD OF THE INVENTION

The present invention relates to pieces of furniture, such as desks, tables or shelves.

In particular, the invention relates to a new structure for such pieces of furniture, this structure being aimed at allowing assembling the furniture according to different configurations.

DESCRIPTION OF THE PRIOR ART

It is known that in the industrial production of pieces of furniture, such as desks, tables, shelves and others, there is the need for modular structures, which can be transported disassembled to the installation place and then assembled in a simple, rapid and stable way.

For this purpose, different systems of assembly and locking of the components of such structures have been proposed.

Some of them, include matching connection between the components, which are then fastened with screws or the like, using also suitably prepared holes.

Other known fastening systems, include cylindrical block with threaded holes, which are inserted in corresponding seats made at the coupling extremities of the elements.

Complementary elements feature suitable holes, into which screws are introduced, which screws engage the threaded holes of the cylindrical blocks.

According to other systems, only lock joints couple the elements.

All the above mentioned assembly and fastening systems are affected by one or more drawbacks, which include insufficient strength or coupling instability, difficulty of the fastening operations, or considerable amount of time required for these operations.

Moreover, all known assembly and fastening systems have a little modularity and expansibility of the assembly configurations, especially when multifunctional pieces of furniture are mounted.

SUMMARY OF THE INVENTION

The main object of the present invention is to propose a structure, by which pieces of furniture are obtained with a limited number of elements, a simple and easy configuration of components, even in those articles which are complicated and multifunctional.

Another object of the present invention is to propose a structure, which allows obtainment of stable, strong couplings, requiring short installation time.

The above-mentioned objects are obtained, in accordance with the content of the claims, by means of a structure for obtaining pieces of furniture of variable configuration, including a plurality of different types of assembling elements, which are coupled with one another, in a stable and removable way, to support at least a desktop, said structure including, among different types of assembling elements:

a sleeve featuring a lateral wall equipped with male quick connection joint means, extending from said lateral wall;

a bar, aimed at coupling with a pair of said sleeves, in direction substantially perpendicular to the sleeves, to form a bearing structure of a said piece of furniture, said bar featuring extremities equipped with female quick connection joint means complementary to said male quick connection joint means;

a leg for supporting said bars and sleeves in co-operation with other legs.

BRIEF DESCRIPTION OF THE DRAWINGS

The characteristic features of the present invention will be pointed out in the following description of a preferred, but not only embodiment, with reference to the enclosed drawings, in which:

FIG. 2 is a front view of the piece of furniture of FIG. 1;

FIG. 3 is a partially section view of a particular of the piece of furniture of previous Figures, showing the bar-bracket coupling;

FIG. 4 is a section view taken along IV—IV of FIG. 3;

FIG. 5 is a section view taken along V—V of FIG. 4;

FIG. 6 is a section view taken along VI—VI of FIG. 3;

FIG. 7 is a side section view of a desktop carrying bracket;

DESCRIPTION OF THE PREFERRED EMBODIMENTS

Figure 1:
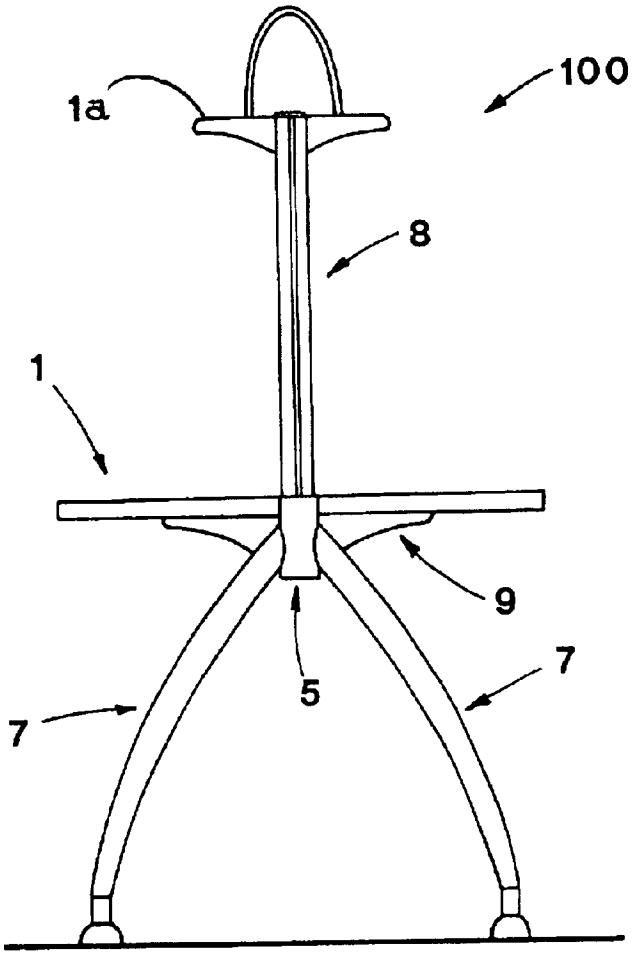
FIG. 1 is a side view of a multifunctional piece of furniture, made according to the present invention.

With reference to FIGS. 1 and 2, reference numeral 100 indicates, in its whole, a particular configuration of the multifunctional piece of furniture obtainable with the structure proposed by the present invention.

More precisely, the piece of furniture 100 is a modular desk, equipped in its upper part with a shelf extending along the whole length of the desk.

The above structure includes different types of assembling elements, which are to be coupled one with another, in a stable and removable way, so as to support one or more shelves 1, 1*a* at predetermined height distances from the ground. Obviously, each particular configuration can use or not one or more elements of the structure, in relation to the desired result.

A basic type of element of the above mentioned structure is a substantially tubular sleeve 5 with circular cross section (see also FIGS. 3, 4, 5, 6).

The sleeve 5 is hollow inside and open at its ends, so as to present at one of these ends an aperture conventionally indicated as upper aperture 57, and at the opposite ends, a lower aperture 58.

However, other conformations of the sleeve 5, remaining within the scope of the present invention, are possible, e.g. a box-like structure of polygonal section, closed or open.

In the region of its lateral wall 55, the sleeve 5 features male quick connection joint means 56, extending from the lateral wall 55.

The male quick connection joint means 56 include a pair of pins 56*a*, 56*b*, arranged aligned axially on the lateral wall 55 of the sleeve 5.

Each of the pins 56*a*, 56*b* has a lateral groove 56*c*, disposed orthogonal with respect to the axis of the pins.

For each pair of pins 56*a*, 56*b*, the sleeve 5 includes a reinforcing plate 59 fastened to the inner wall 55*a* of the sleeve 5 and aimed at allowing a safer coupling of the pins 56*a*, 56*b*.

The plate 59 has a partial-cylinder shape, so as to lean and match wholly against the inner wall 55*a*.

Moreover, the plate 59 features seats 59*a*, 59*b* aimed at firmly receiving the coupling extremities of the corresponding pins 56*a*, 56*b*.

The seats 59*a*, 59*b* are formed by threaded holes, aligned with corresponding through holes made in the sleeve 5, and receive the pins 56*a*, 56*b* in screw engagement.

According to the embodiment shown in the above-mentioned figures, the sleeves have two pairs of pins 56*a*, 56*b*, situated diametrically opposite one to the other.

Obviously, there can be more pairs of pins 56*a*, 56*b*, arranged with predetermined angular distances, in relation to different assembly needs.

Another type of the element of the structure 100 is formed by a bar 6, of substantially linear extension, preferably made from a box-like tubular piece of suitable characteristics.

The bar 6 shown in the Figures has a straight conformation, but it can be also curved of different forms and dimensions.

The bar 6 is aimed at being coupled with a pair of above described sleeves 5, in a direction substantially perpendicular to the axis of the latter, to form the bearing structure for the above mentioned piece of furniture 100, or a part of it.

At both its ends 6*a*, 6*b*, each bar 6 features female quick connection joint means 66, which are complementary to the previously mentioned male quick connection joint means 56 and couple therewith in a stable and removable way.

In particular, for each extremity 6*a*, 6*b* of the bar 6, the female quick connection joint means 66 include a pair of blocks 66*a*, 66*b*, fastened to the inner part 6*c* of the bar 6.

The blocks 66*a*, 66*b* have respective longitudinal holes 67*a*, 67*b*, which receive the corresponding pins 56*a*, 56*b*.

For this purpose, the inner diameter of the longitudinal holes 67*a*, 67*b* is slightly bigger than the outer diameter of the pins 56*a*, 56*b*, so as to receive the latter with as small clearance as possible.

Moreover, the blocks 66*a*, 66*b* are equipped with respective transversal through threaded holes 68*a*, 68*b*, which pass also through the bar 6 and lead to the longitudinal holes 67*a*, 67*b*.

Inside each transversal hole 68*a*, 68*b* there inserted is a threaded dowel 69*a*, 69*b*, aimed at being introduced into the respective transversal hole 68*a*, 68*b* until it engages with the corresponding longitudinal hole 67*a*, 67*b*, so as to fix the related pin 56*a*, 56*b* inside the longitudinal hole 67*a*, 67*b*, in correspondence to the groove 56*c* thereof.

Another element of the proposed structure includes a leg 7, which, together with other identical or similar elements, supports the sleeves 5 and the bar 6 at a predetermined distance from the ground.

According to the embodiment shown in FIGS. 1 and 2, the pairs of legs 7 are fastened to the lateral wall 55 of the relative sleeves 5, by e.g. welding.

The legs 7 are arranged one diametrically opposite to the other and orthogonal to the male quick connection joint means 56.

For pure aesthetic reason, the legs 7 are slightly curved and tend to space out near the ground.

Obviously, also the legs 7 of even very different configurations can be protected by the present structure.

The legs 7 are also fastened, according known techniques, to the bar 6, in a longitudinal position, in which they do not interfere with the female quick connection joint means 66.

Another assembly element is a desktop carrying bracket 9 (see also FIG. 7), aimed at being fastened orthogonal to the bar 6 to facilitate the support of the desktop 1.

The bracket 9 includes a pair of substantially symmetrical wings 94, 95, which extend from a central body 96.

The latter is equipped with a housing 97, whose section is substantially identical to the cross section of the bar 6, so as to couple therewith.

There are also fastening means 98, which fasten the bracket 9 to the bar 6.

The fastening means 98 include a pair screw-bolt, which is aimed at being introduced in corresponding through holes made in the bar 6 and the body 96 of the bracket 9.

The piece of furniture 100 described so far corresponds to a modular table or desk of changeable configuration, and is substantially the basic article obtainable with the present structure.

Other compositions can be obtained by using an element of the structure formed by an extension upright 8, which is substantially cylindrical and is aimed being fixed into the upper aperture 57 of the sleeve 5, in abutment against the reinforcement plates 59.

A pair of the extension uprights 8 can be introduced, orthogonal to the desktop 1, into the upper apertures 57 of the corresponding sleeves 5.

Therefore, shelves 1*a* supporting books, file-holders or others, can be inserted between the extension uprights 8.

In this case, a bookcase is created over the desk, in a simple and stable way.

In this case, the means and techniques for fastening the shelves 1*a* can be chosen from the known ones.

If the piece of furniture 100 does not include the extension uprights 8, suitable covers, not shown, can cover the upper apertures 57 of the sleeves 5.

Figure 8:
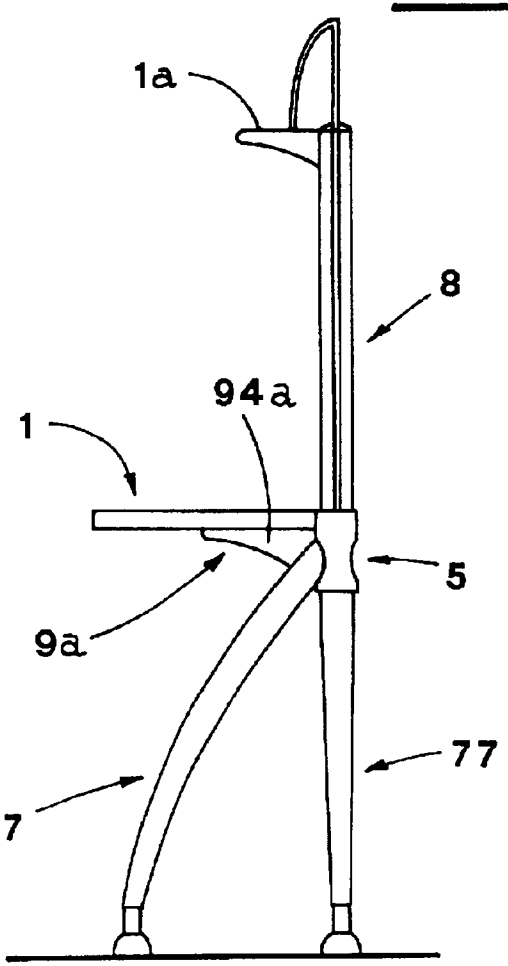
FIG. 8 is a view of a different embodiment of the piece of furniture of FIG. 1.

According to a different configuration of the piece of furniture 100, shown in FIG. 8, it is formed in such a way as to be leant against a wall.

In this case, the desktop is fastened to the bar 6 near its longitudinal edge, and not in the region of the central longitudinal line thereof.

Moreover, in order to obtain this conformation, there is mounted another element formed by a bracket 9*a* having only one wing 94*a* and an additional, substantially straight leg 77, which is fixed into the lower aperture 58 of the sleeve 5, in abutment against the plates 59.

Figure 9:
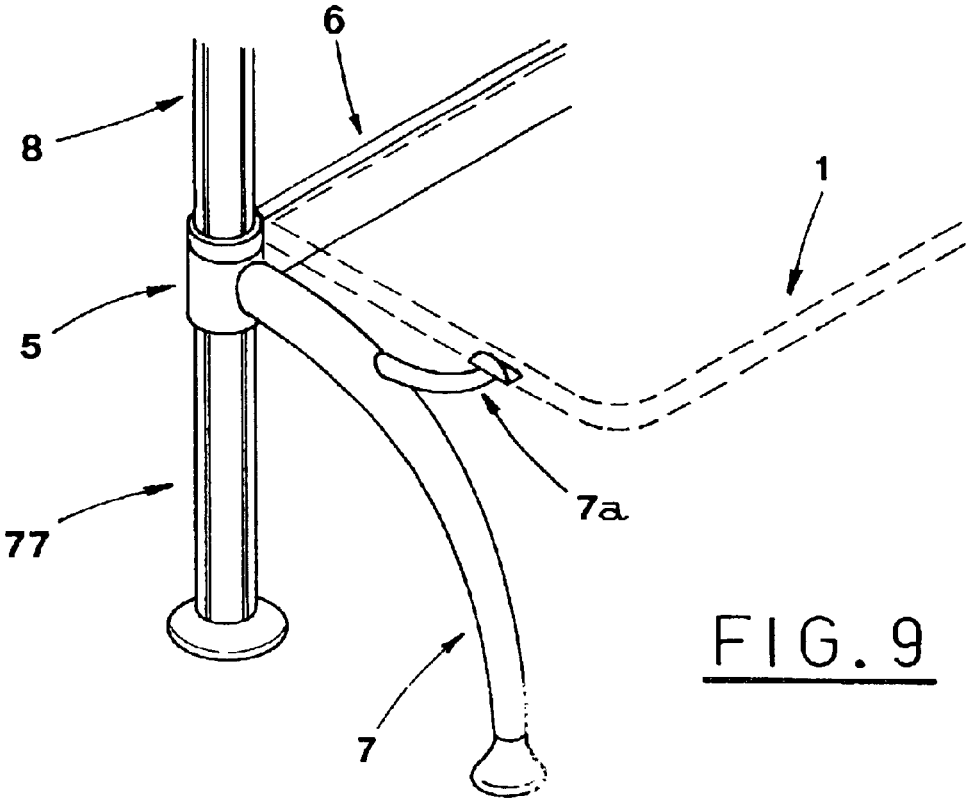
FIG. 9 is a perspective view of a particular of the piece of furniture according to the above mentioned different embodiment.
Figure 10:
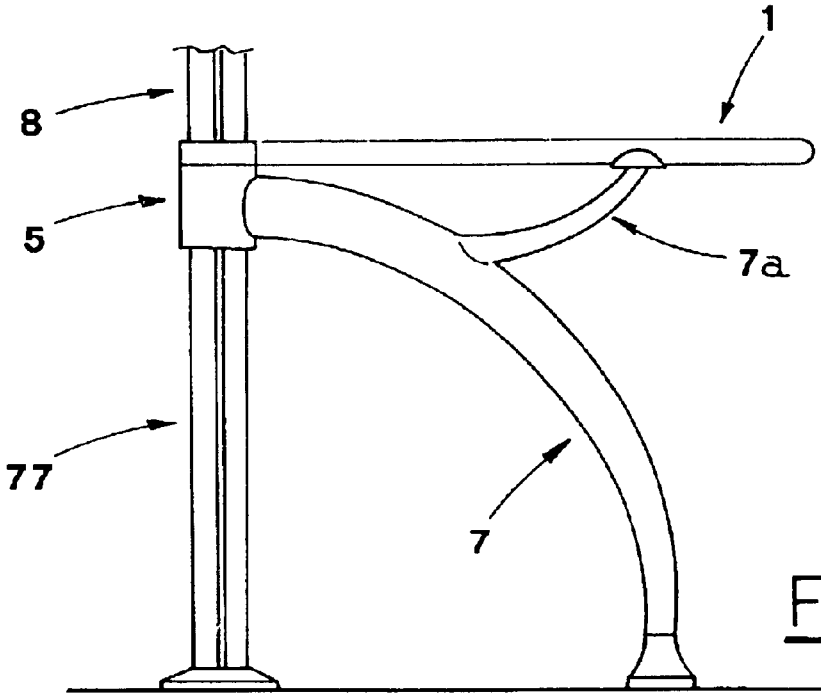
FIG. 10 is a lateral view of the particular of FIG. 9.

According to a further embodiment, the leg 7 (see FIGS. 9 and 10) can have a protrusion 7*a*, extending upwards from a median area of the leg 7, aimed at supporting the desktop 1, in addition to or replacing the desktop carrying bracket 9.

The present structure has also other elements, which increase the versatility and typology of the piece of furniture which can be obtained by their use.

In particular, there are panels 85, 85*a* (FIG. 11), of predetermined dimensions, which can be associated respectively to the additional legs 77 and uprights 8, in order to define separation walls 86.

Also the additional leg 77 can have a protrusion 77*a*, which extends from a median portion thereof toward the ground, to stabilize its working position.

Figure 11:
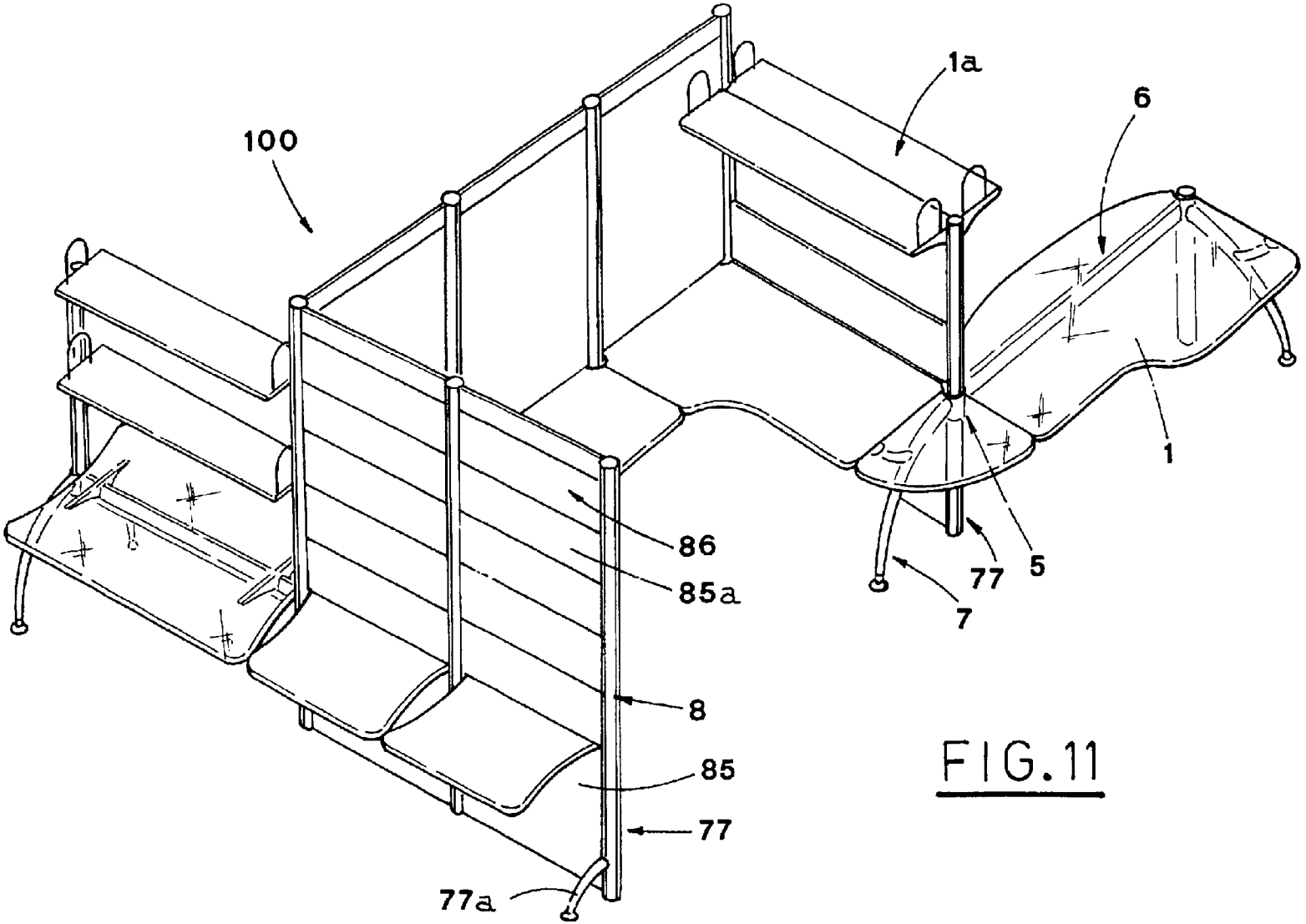
FIG. 11 is a perspective view of a piece of furniture obtained according to the above-mentioned different embodiment.

FIG. 11 illustrates an example of a possible complex composition of a piece of furniture 100 obtained by the present structure.

The use of the above mentioned structure for forming a piece of furniture 100 is extremely simple and easy to conceive.

Actually, in order to obtain a basic article, a bar 6 is first coupled with a pair of sleeves 5, which, according to the embodiment shown in FIGS. 1 and 2, are equipped with related pairs of legs 7 already fixed in their working position, by e.g. welding.

The coupling is obtained simply by placing one end of the bar 6 close to the sleeve 5, so that the pins 56*a*, 56*b* enter the holes 67*a*, 67*b* of the blocks 66, 67 and then, the corresponding dowels are tightened with a screwdriver.

Afterwards, a pair of desktop carrying brackets 9 are fastened to the bar 6, near the extremity of the latter, in such a way that the bar 6 slides inside the housing 97, and then the brackets are locked by the screw-bolt assembly 98.

The desktop 1 is first set against the brackets 9 and then fastened thereto by screws.

Then, a pair of extension uprights 8 are installed, by simply fixing the respective lower extremities into the corresponding upper apertures 57 of the sleeves 5, until these extremities go in abutment against the reinforcement plates 59.

Finally, other shelves 1*a* can be applied to the uprights 8, in the already described way.

The so obtained piece of furniture 100 can be easily enlarged and configured in a different way even after the first assembly, by adding elements composed of other bars 6, which can be coupled with rapid fixing means 55 remained unused in the sleeves 5, and of other sleeves 5 equipped with corresponding pairs of legs 7, as well as of other desktops 1, and possibly, other uprights 8 and shelves 1*a*.

Obviously, in case of a piece of furniture leaning against a wall, it is necessary to provide, in addition to the desktop 1 and shelves 1*a*, also sleeves 5 (equipped with only one leg 7) and adequate desktop bearing brackets 9, a pair of additional legs 77, which must be assembled by fixing into the lower apertures 58 of the sleeves 5, until they go in abutment against the reinforcement plates 59.

The advantages obtained by use of the structure according to the present invention result chiefly from the extreme assembly simplicity and considerable stability of the couplings between different elements of the structure, and in particular from the versatility of the sleeve 5.

Actually, the most of the couplings are obtained without nuts and bolts, thus with coupling components already inserted in a firm way into the respective elements.

Another advantage results from the versatility of the whole structure, and from the possibility to obtain numberless different configurations, also of multifunctional pieces of furniture, with an extremely reduced number of elements.

It is understood that what above, has been described as a pure, unlimited example, therefore, possible variants of the invention remain within the protective scope of the present technical solution, as described above and claimed hereinafter.

What is claimed is:

1. A structure for obtaining pieces of furniture of variable configuration, including a plurality of different types of assembling elements, which are coupled with one another, in a stable and removable way, to support at least a desktop, said structure including, among different assembling elements:

a sleeve featuring a lateral wall equipped with male quick connection joint means, extending from said lateral wall and including at least one pair of pins, aligned axially on the lateral wall of said sleeve and having an extremity for coupling;

a bar connected with a pair of said sleeves, in direction substantially perpendicular to the sleeves, to form a bearing structure for said pieces of furniture, said bar having extremities equipped with female quick connection joint means and including:

at least one pair of blocks, fastened to the inner wall of said bar, having respective longitudinal holes for engagement with the corresponding male quick connection joint means, and with respective threaded through holes, passing through said bar and opening into said longitudinal holes;

for each of said through holes, a threaded dowel inserted into the respective through hole and screwed into engagement with a corresponding longitudinal hole, so as to fix said male quick connection joint means inside said longitudinal hole;

a leg for supporting said bars and sleeves in co-operation with other legs.

2. A structure, according to claim 1, wherein a shape of said sleeve is substantially tubular.

3. A structure, according to claim 2, wherein the cross-section of said sleeve is substantially circular.

4. The structure, according to claim 1, wherein said sleeve has at least one upper aperture for receiving a corresponding upright for extension of said piece of furniture in a direction orthogonal with respect to said desktop.

5. Structure, according to claim 4, further including a panel, which can be associated to at least one pair of said uprights to define a portion of a separation wall.

6. The structure, according to claim 1, wherein said sleeve includes, fastened to an inner wall thereof, at least one reinforcement plate, equipped with seats, which receive firmly said extremity for coupling of each corresponding pin.

7. The structure, according to claim 1, wherein said pins include a lateral groove, arranged orthogonal to an axis of said pins.

8. The structure, according to claim 1, wherein said male quick connection joint means include a plurality of pairs and pins, each of said pairs of pins having one pin arranged on said outer lateral wall of said sleeve, in a position angularly distanced with respect to the other of said pair of pins, for coupling with a plurality of bars.

9. The structure, according to claim 8, wherein said pins include a lateral groove, arranged orthogonal to an axis of said pins.

10. The structure, according to claim 1, wherein each of said legs is fastened to said outer lateral wall of the sleeve, in an angular position, in which said leg does not interfere with said male quick connection joint means.

11. The structure, according to claim 1, wherein each of said legs is fastened to said bar, in a longitudinal position, in which said leg does not interfere with said female quick connection joint means.

12. The structure, according to claim 1, wherein each of said legs has a protrusion, extending from a median area of said leg toward said desktop to help support said desktop.

13. A structure, according to claim 1, wherein said sleeve has at least one lower aperture aimed at receiving a corresponding additional leg, which helps support said piece of furniture.

14. Structure, according to claim 13, wherein said additional leg features a protrusion extending from a median portion of said additional leg toward the ground, to stabilize its working position.

15. Structure, according to claim 13, further including a panel, which can be associated to at least one pair of said additional legs to define a portion of a separation wall.

16. A structure, according to claim 1, wherein said different types of assembly elements includes a desktop bearing bracket, aimed at being fastened orthogonal to said bar to facilitate the support of said desktop, said bracket including a pair of substantially symmetrical wings which extend from a central body, the latter being equipped with a housing, whose section is substantially identical to the cross section of said bar, so as to couple therewith, with fastening means being aimed at fastening said bracket to said bar.

17. Structure, according to claim 16, wherein said fastening means include at least one screw-bolt assembly for insertion into corresponding through holes made in said bar and in said body of said bracket.

* * * * *